United States Patent [19]

Müller

[11] 4,291,769

[45] Sep. 29, 1981

[54] FOAM FIRE EXTINGUISHING UNIT FOR RESCUE VEHICLE

[76] Inventor: Erich Müller, Saumweg 15, D-7918 Illertissen, Fed. Rep. of Germany

[21] Appl. No.: 87,266

[22] Filed: Oct. 22, 1979

[30] Foreign Application Priority Data

Oct. 24, 1978 [DE] Fed. Rep. of Germany ..... 2846150

[51] Int. Cl.[3] ..... A62C 27/06

[52] U.S. Cl. ..... 169/13; 169/24; 239/332; 239/373; 239/110

[58] Field of Search ..... 169/9, 13–15, 169/30, 62, 24, 16, 18; 222/333, 372, 373, 63; 239/373, 332, 110, 104; 417/26, 28, 234, 316–318

[56] References Cited

U.S. PATENT DOCUMENTS

| | | | |
|---|---|---|---|
| 2,434,771 | 1/1948 | Mueller et al. | 417/316 X |
| 2,895,688 | 7/1980 | Seiberling et al. | 239/110 X |
| 3,234,962 | 2/1966 | Williamson | 169/13 X |
| 3,375,875 | 4/1968 | Wesson | 169/9 |
| 3,709,302 | 1/1973 | Stults | 169/9 |
| 3,770,060 | 11/1973 | Forsyth et al. | 169/24 |
| 3,801,015 | 4/1974 | Hayes | 239/373 X |
| 3,878,896 | 4/1975 | White et al. | 169/9 |
| 4,030,665 | 6/1977 | Koyama | 239/332 X |
| 4,155,509 | 5/1979 | Koyama | 239/373 |

*Primary Examiner*—Stanley H. Tollberg
*Assistant Examiner*—Fred A. Silverberg
*Attorney, Agent, or Firm*—Blanchard, Flynn, Thiel, Boutell & Tanis

[57] ABSTRACT

New foam fire extinguishing unit for incorporation into rescue cars is described. It consists of a container which contains a liquid adapted to be used for foam production without adding further ingredients. To the container a device is connected which feeds the fire extinguishing liquid under pressure from the container to a hand-held foam generating nozzle. The device may comprise a motor driven pump or an air pressure device. The foam fire extinguishing unit may be a mixture of water and "Light Water". The new foam fire extinguishing unit can also be used as a stationary unit in work shops and warehouses.

1 Claim, 2 Drawing Figures

FOAM FIRE EXTINGUISHING UNIT FOR RESCUE VEHICLE

BACKGROUND OF THE INVENTION

Motorized rescue cars in particular used in connection with traffic accidents are equipped with hand fire extinguishers which have a relatively small contents and can be re-filled after each application by specialists only. Since rescue cars must be ready for duty at any time additional fire extinguishers must be kept in reserve. All this results in a relatively complex and uneconomical handling of the fire extinguishing equipment.

Fire departments use trucks or vans provided with large tanks filled with water which tanks can be connected via pumps with jet pipes. The addition of foam producing ingredients to the water is accomplished via a special mixing valve. This arrangement operates properly only with large quantities of water. Such quantities can not be transported with the usual rescue cars.

OBJECT AND SUMMARY OF THE INVENTION

It is the object of the invention to provide a foam fire extinguishing unit which is adapted to be incorporated in todays rescue cars and is easy to be refilled or which can be used stationarily.

According to a further object to the invention a foam fire extinguishing unit which is ready for operation at any time and contains a sufficient quantity of extinguishing medium to extinguish burning cars or the like.

According to the invention there is provided a foam fire extinguishing unit particularly adapted for incorporation into rescue cars or the like comprising a container which contains a liquid adapted to be used for foam production without further ingredients and a means connected to the container and adapted to feed extinguishing liquid contained in the container under pressure to a jet pipe.

DESCRIPTION OF THE EMBODIMENTS

Figure 1:
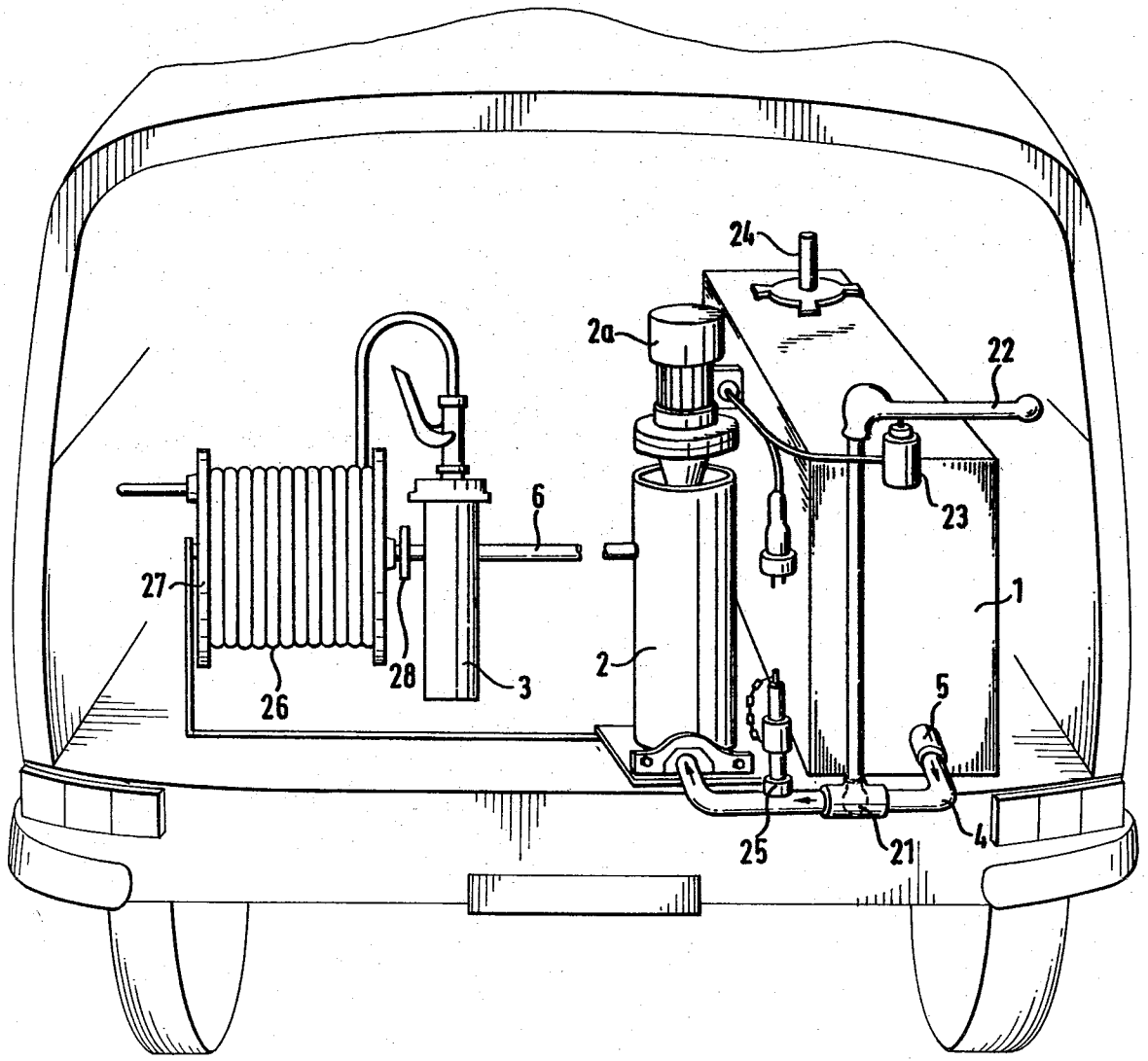
FIG. 1 shows a schematic view of one embodiment of the foam fire extinguishing unit according to the invention.
Figure 2:
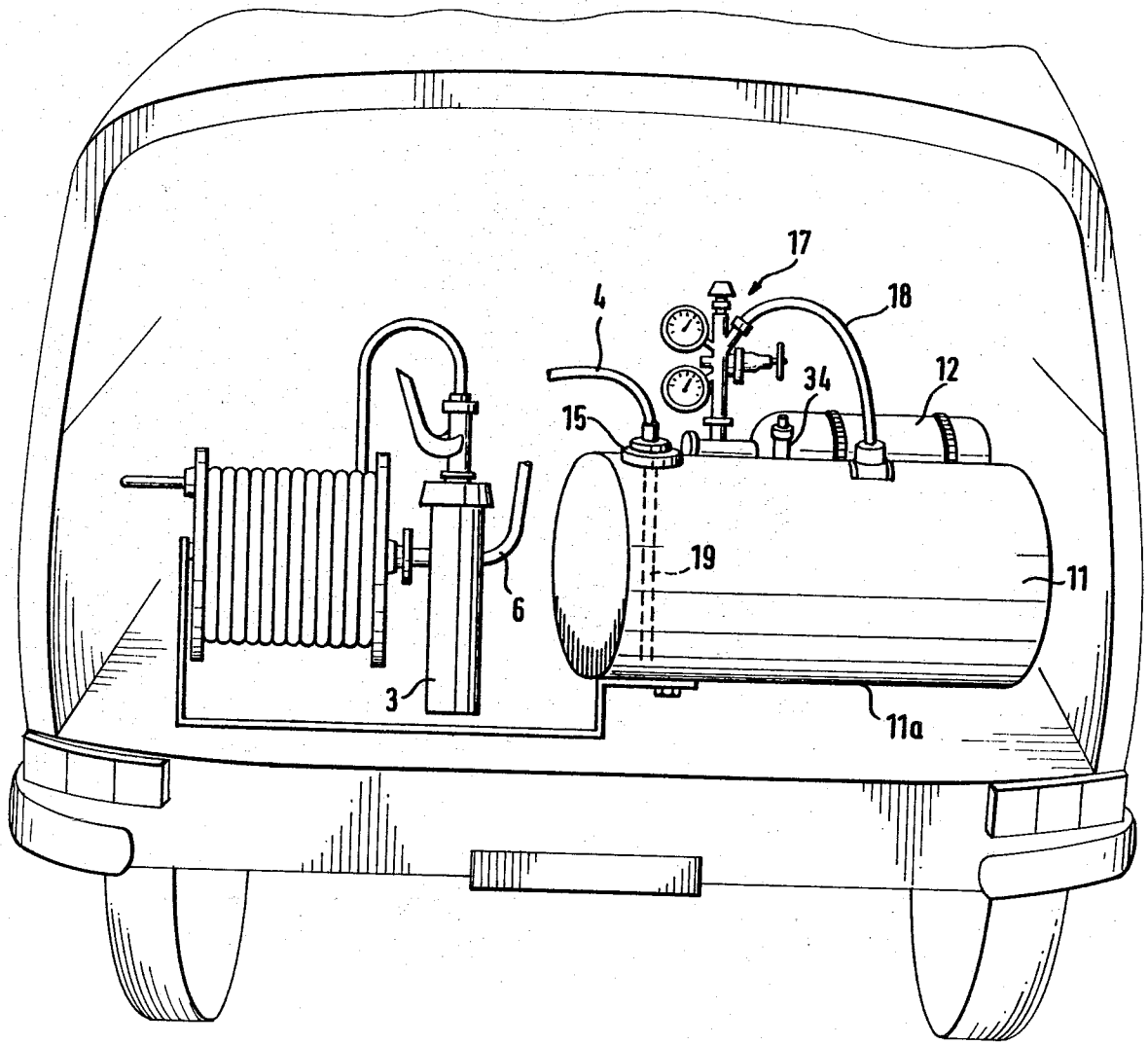
FIG. 2 is a schematic view of another embodiment of a foam fire extinguishing unit according to the invention.

FIG. 1 shows a container with rectangularly shaped side planes with a contents of preferably 30 to 200 liters where for the specific embodiment the contents ranges between 50 and 100 liters. The shape of the container 1 is preferably chosen in such a way that it can be optimally incorporated into a motorized rescue car or a fire department car. The container 1 contains the extinguishing liquid which produces foam without addition of further chemical ingredients just by adding air to the jet pipe 3. As a liquid is particularly used Light-Water manufactured by the Minnesota Mining and Manufacturing Corp., which liquid is added to a corresponding quantity of water in a manner know per se. The liquid is filled into the container via the filling pipe 24 which preferably is of a tubelike shape and which is adapted to be used as a measuring rod and ventilation or airation. With the first embodiment according to FIG. 1 the liquid is fed via a pump out of the container 1 which may be a rotary pump 2 driven by an electric motor 2*a*. The electric motor is connected to the power supply provided in each rescue car. The pump 2 is connected via a connection tube 4 to a connection output 5 of the container 1 which is provided at or adjacent to the bottom of the container 1. Alternatively, the connection output 5 may be arranged at any position of the container provided that it has a connection to the vicinity of the bottom 11*a* for instance via pipe 19 (FIG. 2). Between the container 1 and the pump 2 preferably a valve 21 is inserted which may be a usual ball valve or any other type of valve. Actuation of the valve 21 is preferably by hand, even so electro-magnetical or pneumatical actuation is possible. With the embodiment there is a hand lever 22 which may be rocked between an ON-position and an OUT-position. In the ON-position the hand lever presses an electrical switch 23 which closes the current path for the electric motor 2*a*. Of course, the electric motor may also be actuated by hand switch. The shown solution assures a concurrent actuation of the valve 21 and the switching on of the electric motor 2*a*, which prevents failures and undesired overloading. Between the valve 21 and the pump 2 a connection branch 25 is provided at the connection tube 4 where for instance a water hose can be connected, too, for cleaning the pump and the subsequent pipes and hoses after use from the relatively aggressive extinguishing liquid. The connection branch 25 may be combined with a back-pressure-valve. At the output of pump 2 there is provided a pipe line 6 connected to an input connection 28 of a reel 27 carrying a hose, in particular a usual ½" hose 26 having connected to its other end a hand-held jet pipe or foam generating nozzle 3. The jet pipe 3 is formed as a known fan jet pipe with air addition which, however, according to the invention is of a smaller size as usual, for instance with a length between 40 cm and 100 cm.

In operation of the fire extinguishing unit according to the invention the hand lever 22 is rocked into the shown position, whereby the valve 21 is opened and the electric motor 2*a* is switched on. The operator grasps the jet pipe 3 and draws the hose 26 from the reel 27 when running towards the fire.

Instead of the rotary pump any other pump may be used; also, the electrical drive for the pump may be replaced by any other drive, for instance a hydraulical drive or a drive derived from the motor of the rescue car.

FIG. 2 shows an alternative embodiment where the feeding of the extinguishing liquid from the container 11 is accomplished by driving the extinguishing liquid under pressure out of the container. For this purpose there is provided a compression tank 12 in particular filled with compressed air which is adapted to be connected preferably via a controllable locking device 17 and a pipe line 18 to the container 11. The ventilation is accomplished with the present embodiment via a valve 34 which preferably consists of sintered metal. With this embodiment the container 11 is shown of cylindrical shape. The compressed air may be produced by the rescue car as an alternative solution. With the second embodiment the output connection 15 of the container 11 is provided at the upper side being connected in the interior of the container via a pipe 19 with the vicinity of the bottom 11*a* of the container.

The invention also relates to a rescue- or fire extinguishing car provided with the extinguishing unit described above, where the container, the pump 2 or the compression tank 12, respectively, are arranged just in free spaces of the car. In particular, the reel 27 can be arranged either at the side of the car or at the rear in a manner that immediate access to the jet pipe 3 is ensured. The connection pipes and/or the electrical lines offer the possibility, if desired, to arrange the container at some distance from the pump 2 or the compression tank 12, respectively, and the reel 27.

By using a fan jet pipe which may be provided with a quick-closing valve an ideal distribution of the extinguishing liquid is provided. The costs for refilling are low, since the container can be refilled by the normal operator. It should be noted that the unit needs very little maintenance and is not sensitive to any failures.

Though the extinguishing unit according to the invention is particularly adapted for incorporation into rescue cars it also could be used as a stationary extinguishing unit placed at particular dangerous places like work shops, garages and so on.

The connection lines can be hoses or tubes. It should be noted that for air compression it is advantageous to provide the container with a connection means to which a breathing air flask or cylinder usually available in rescue cars can be attached.

The containers 1 and 11 may be made of fine or superrefined steel.

I claim:

1. A quick-use foam fire extinguishing unit, comprising:

a container;

a premanufactured mixture of water and a conventional watery film-forming foam medium in said container;

a tubelike filling pipe mounted on an upper wall of said container for facilitating a filling of said container with said mixture;

an outlet adjacent a bottom wall of said container;

a pump having an inlet at the bottom end thereof and an outlet spaced upwardly from said inlet;

a first outlet pipe connected to and extending between said outlet in said container and said inlet to said pump;

a valve in said first outlet pipe between said container outlet and said inlet to said pump;

a hand operated lever operatively connected to said valve for facilitating an opening and closing of said valve, said lever extending upwardly from the valve to a position above the top of the container with a horizontal portion extending along the top of the container;

A switch mounted adjacent the top of said container adjacent said hand operated lever, said switch being actuated in response to a movement of said lever to a position corresponding to said valve being opened, wherein the horizontal portion directly abuts the switch for operation thereof;

a motor operatively connected to said pump and electrically connected to said switch, said motor being actuated in response to said switch being actuated to thereby effect a driving of said pump;

a hose reel having an inlet at the center thereof;

a second outlet pipe connected to and extending between said pump outlet and said inlet on said hose reel;

an elongated hose on said hose reel connected in fluid communication with said inlet on said hose reel;

a hand held jet pipe connected to a free end of said hose and being movable independently of said hand operated lever; and a connection branch in said first outlet pipe located between said valve and said inlet to said pump and being adapted for connection to a water supply hose for cleaning said pump, said second outlet pipe and said hose following a use thereof with said mixture.

* * * * *